United States Patent [19]

Burbach et al.

[11] Patent Number: 4,768,267

[45] Date of Patent: Sep. 6, 1988

[54] METHOD FOR ASSEMBLING A GAS CIRCULATION BLOCK PROVIDED FOR METALLURGICAL VESSELS

[76] Inventors: Werner Burbach, Gerberstrasse 12; Günter Bender, Johann-Moritz Strasse 12, both of 5905 Freudenberg, Fed. Rep. of Germany

[21] Appl. No.: 99,693

[22] Filed: Sep. 18, 1987

Related U.S. Application Data

[63] Continuation of Ser. No. 888,504, Jul. 23, 1986, abandoned.

[30] Foreign Application Priority Data

Aug. 2, 1985 [DE] Fed. Rep. of Germany ..... 3527793

[51] Int. Cl.[4] ..... B21D 53/00; C21B 7/16

[52] U.S. Cl. ..... 29/157 R; 29/447; 266/220

[58] Field of Search ..... 29/447, 157 C, 157 R; 266/220; 164/477, 475, 259, 66.1

[56] References Cited

U.S. PATENT DOCUMENTS

| | | | |
|---|---|---|---|
| 3,490,755 | 1/1970 | Lutgen | 266/220 |
| 3,579,805 | 5/1971 | Kast | 29/447 |
| 4,332,073 | 6/1982 | Yoshida et al. | 29/447 X |
| 4,560,149 | 12/1985 | Höffgen | 266/220 |
| 4,616,809 | 10/1986 | Höffgen | 266/220 |

FOREIGN PATENT DOCUMENTS

| | | | |
|---|---|---|---|
| 684048 | 12/1952 | United Kingdom | 266/220 |

*Primary Examiner*—Timothy V. Eley
*Attorney, Agent, or Firm*—Brooks & Kushman

[57] ABSTRACT

During the assembly of a gas circulation block, encased in sheet metal, a conical sheet-metal sleeve is placed onto a shaped block which is in the form of a truncated cone and made of a refractory material, then a sheet-metal cover provided with a gas supply tube is laid onto the larger end face of the shaped block and then the sheet-metal sleeve is welded onto the sheet-metal cover. In order to reduce the assembly effort and at the same time to create an improved gas circulation block, the conical sheet-metal sleeve is heated up before placing onto the shaped block and is then shrunk onto the shaped block. By the shrinking of the sleeve, every type of dimensional inaccuracy is compensated for, whether on the shaped block or on the sheet-metal sleeve, so that the sheet-metal sleeve, in the shrunk-on condition, sits uniformly and tightly against the shaped block over its entire periphery and its entire length.

2 Claims, 1 Drawing Sheet

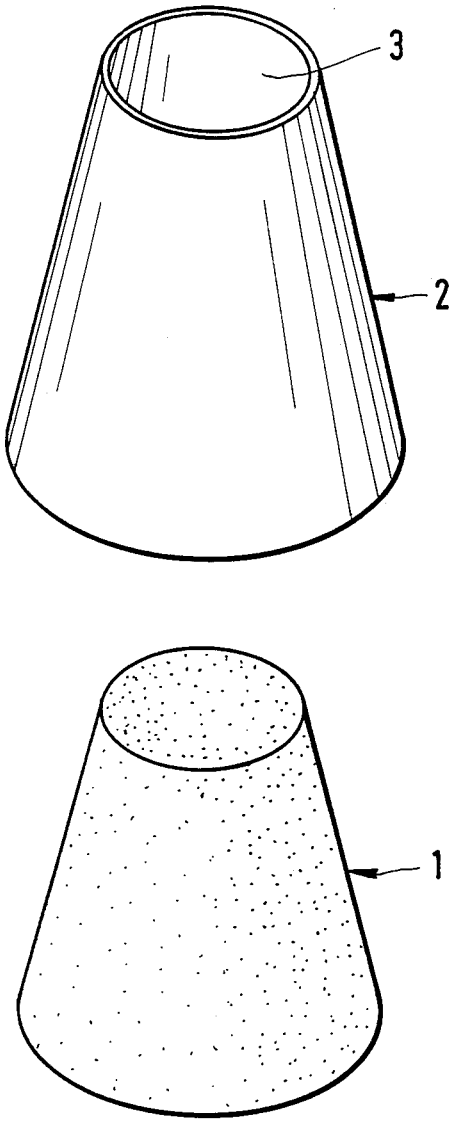
3
2
1

METHOD FOR ASSEMBLING A GAS CIRCULATION BLOCK PROVIDED FOR METALLURGICAL VESSELS

This is a continuation of co-pending application Ser. No. 888,504 filed on July 23, 1986, abandoned.

The invention relates to a method of assembling a gas circulation block, encased in sheet metal, in which a conical sheet-metal sleeve is placed onto a shaped block which is in the form of a truncated cone and made of a refractory material, then a sheet-metal cover provided with a gas supply tube is laid onto the larger end face of the shaped block and then the sheet-metal sleeve is welded to the sheet-metal cover.

In particular in the case of gas circulation blocks, in which the refractory shaped block is made of a material permeable to gas or has a directed porosity, it is important that the peripheral gap between the lateral outer surface of the shaped block and the conical sheet-metal sleeve is absolutely tight, for otherwise the gas would not flow specifically through the shaped block but, according to the principle of least resistance, would flow through the free gap between the shaped block and the sheet-metal casing. In practice, the conical form of the lateral outer surface of the shaped block does not always conform exactly with the conical form of the sheet-metal sleeve, so that the sheet-metal sleeve, as a rule, does not sit flush against the shaped block over its entire periphery and its entire height. In known gas circulation blocks, a mortar layer is therefore provided between the shaped block and the sheet-metal sleeve, with which it is possible to compensate tolerances.

Because of the application of the mortar layer, this known method is relatively complicated. Although a gap which is initially well sealed by the mortar seam is achieved by applying this method, the seam filling the gap is usually by varying thickness over the periphery and height. When the circulation gas finally does attempt to find its way through the mortar seam when the free outlet end of the shaped block is closed and the seam material breaks out, a so-called edge circulation device results in which the circulation gas issues from the circulation block in a non-uniform distribution or even only on one edge side. Consequently, the requisite fine distribution of the gas bubbles is no longer possible and the circulating operation of the melt is destroyed.

The object of the invention is to reduce the effort in the assembly method of the type mentioned at the beginning, and at the same time to create a better end product.

According to the invention, this object is achieved in that the conical sheet-metal sleeve is heated before placing onto the shaped block and is then shrunk onto the shaped block.

At the same time, heating must take place at an adequate temperature which produces a sufficiently large oversize as a function of the material of the sheet-metal sleeve. When using sheet-metal sleeves of steel or other iron alloys, heating temperatures in the order of magnitude of 600° to 800° C. are expedient.

By placing on the sleeve, which has an oversize as a result of the heating, and by subsequent shrinking of the sleeve, every type of dimensional inaccuracy is compensated for, whether on the shaped block or on the sheet-metal sleeve, so that the sheet-metal sleeve, in the shrunk-on condition, sits tightly against the shaped block over its entire periphery and its entire length. The method according to the invention therefore leads to a perfect product which guarantees a uniform and finely distributed gas admission into the melt in all operating conditions, even in the event of edge circulation. The method according to the invention can also be used in genuine edge circulation devices which have an impermeable shaped block. In edge circulation devices, thin passage channels will then preferably be created purposefully in the area of the gap between the shaped block and the sheet-metal sleeve, for example by milling grooves into the shaped block or by embossing beads into the sheet-metal jacket.

Apart from a better product being created by the method according to the invention, the method itself is also substantially simplified, since a mortar layer between the shaped block and the sheet-metal casing can be completely dispensed with.

The invention is described in detail below and explained with reference to the drawing.

According to the drawing, the shaped block 1, which is made of a refractory material, has the configuration of a truncated cone. The refractory material can be either porous or permeable to gas, or it is impermeable to gas but has a directed porosity in the form of thin, continuous channels. For so-called edge circulation devices, the shaped block 1 can also be completely impermeable to gas.

A conical sheet-metal sleeve 2 is to be placed onto the shaped block 1, the conical form of which sheet-metal sleeve 2 corresponds to that of the shaped block 1. In practice, however, the conical forms do not always conform exactly as a result of technical shortcomings in production, with deviations from the desired cone being observed both in the peripheral direction and over the length of the shaped block 1 or the sheet-metal sleeve 2. Deviations from the specified size are especially found in the shaped block 1, in which case not only can out-of-roundness and deviations from the desired cone shape be present but also individual bulges and depressions.

Before the sheet-metal sleeve 2 is placed onto the shaped block 1 it is heated to 600° to 800° C., with the temperature being selected in such a way that an adequate oversize results as a function of the selected material. Likewise important is also the size of the shrinkage, because greater inaccuracies in the parts can only be compensated for when shrinkage is considerable. The sheet-metal sleeve 2 can be heated by a flame or also, for example, in an annealing furnace.

The heated sheet-metal sleeve 2 is then placed onto the shaped block 1, with the inside cross section 3 closing exactly with the narrower upper end of the shaped block 1. During cooling, the sheet-metal sleeve 2 shrinks onto the shaped block 1 and comes to bear tightly against the shaped block 1 over its entire periphery and over its entire length. At the same time, dimensional inaccuracies are compensated for completely, so that a uniformly tight gap arises between the shaped block 1 and the sheet-metal sleeve 2.

Once the sheet-metal sleeve 2 is shrunk on, a sheet-metal cover (not shown in the drawing), provided with a gas supply tube, is placed onto the larger end face of the shaped block 1 and welded to the shrunk-on sheet-metal sleeve 2.

A sheet-metal sleeve 2 is preferably used which, in the attached condition, projects slightly beyond the wider end of the shaped block 1. Once the sheet-metal cover is laid on, the lower, freely projecting edge of the sheet-metal sleeve 2 is flanged over the sheet-metal cover and the flanged edge is welded to the sheet-metal cover.

We claim:

1. Method of assembling a gas circulating block for metallurgical vessels, made of a shaped block of refractory material in the form of a truncated cone and a bipartite sheet metal cover consisting of a conical sheet metal sleeve for covering the corresponding conical surface of the shaped block and a sheet metal cover provided with a gas supply tube for covering the larger end face of the shaped block, characterized in heating the conical metal sleeve, placing the heated sleeve onto the shaped block, then shrinking the sleeve onto the shaped block by cooling the sleeve to form an air-tight seal between the sleeve and the shaped block, next placing the sheet metal cover provided with the gas supply tube onto the larger end face of the shaped block and welding the sheet metal sleeve to the sheet metal cover.

2. Method according to claim 1, characterized in that the conical sheet metal sleeve is heated to 600° to 800° C. before placing onto the shaped block.

* * * * *